US006856122B2

(12) United States Patent
Dohnal et al.

(10) Patent No.: US 6,856,122 B2
(45) Date of Patent: Feb. 15, 2005

(54) THYRISTOR TAP CHANGER

(75) Inventors: Dieter Dohnal, Lappersdorf (DE); Hans-Henning Lessmann-Mieske, Neutraubling (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 10/416,177

(22) PCT Filed: Dec. 15, 2001

(86) PCT No.: PCT/EP01/14859

§ 371 (c)(1),
(2), (4) Date: May 8, 2003

(87) PCT Pub. No.: WO02/058088

PCT Pub. Date: Jul. 25, 2002

(65) Prior Publication Data

US 2004/0032699 A1 Feb. 19, 2004

(30) Foreign Application Priority Data

Jan. 18, 2001 (DE) ..... 101 02 310

(51) Int. Cl.[7] ..... G05F 1/16
(52) U.S. Cl. ..... 323/258; 323/343

(58) Field of Search ..... 323/258, 263, 323/343, 256, 257, 342, 340, 341, 255

(56) References Cited

U.S. PATENT DOCUMENTS

| | | | | |
|---|---|---|---|---|
| 4,550,285 A | | 10/1985 | Kugler | |
| 4,571,499 A | | 2/1986 | Wein | |
| 5,006,784 A | * | 4/1991 | Sonntagbauer | 323/343 |
| 5,119,012 A | * | 6/1992 | Okamura | 323/258 |
| 5,408,171 A | * | 4/1995 | Eitzmann et al. | 323/258 |
| 5,645,627 A | * | 7/1997 | Lifshutz et al. | 96/15 |

FOREIGN PATENT DOCUMENTS

| | | |
|---|---|---|
| DE | 32 23 892 A1 | 12/1983 |
| DE | 33 04 851 A1 | 8/1984 |
| DE | 101 02 310 C1 | 1/2001 |
| WO | WO 96/27931 | 10/1995 |
| WO | WO 98/48432 | 10/1998 |

* cited by examiner

*Primary Examiner*—Rajnikant B. Patel
(74) *Attorney, Agent, or Firm*—Herbert Dubno

(57) ABSTRACT

A thyristor transformer has a mechanical tap selector and a diverter switch with thyristors. The tap selector is mounted in the oil-filled housing or tank of the transformer and the diverter switch is mounted in a separate housing laterally attached to the tank.

4 Claims, 1 Drawing Sheet

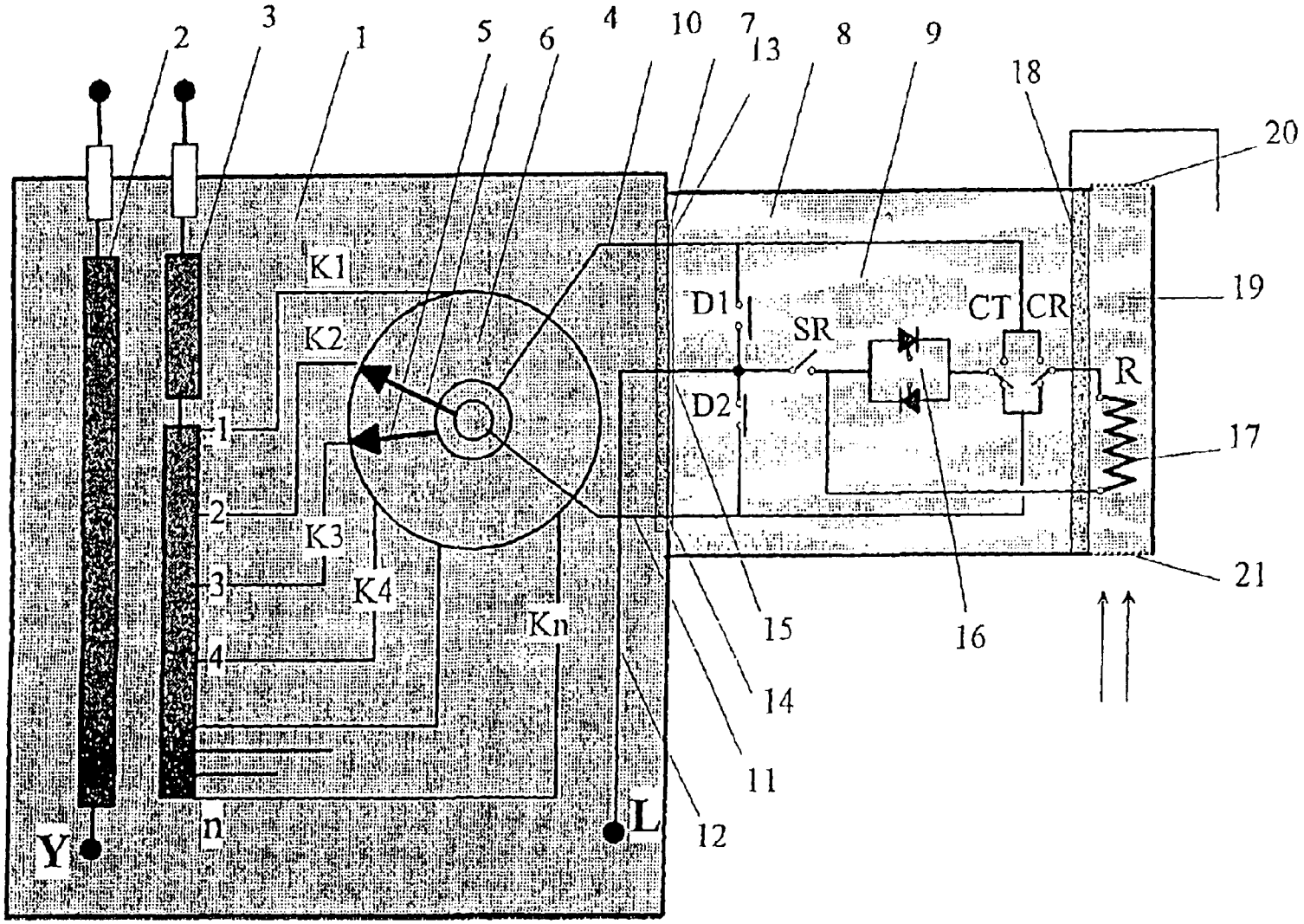
20
19
17
21
18
R
CR
CT
16
9
8
SR
13
7
15
14
11
10
D1
D2
12
4
L
6
Kn
5
K4
1
K1
K2
K3
3
1
2
3
4
n
2
Y

THYRISTOR TAP CHANGER

CROSS REFERENCE TO RELATED APPLICATIONS

This application is the US national phase of PCT application PCT/EP01/14859 filed 15 Dec. 2001 with a claim to the priority of German patent application 10102310.3 itself filed 18 Jan. 2001.

FIELD OF THE INVENTION

The present invention relates to a thyristor tap changer for uninterrupted switching over between different winding taps of a tapped transformer under load, consisting of a mechanical tap selector for power-free preselection of the respective winding tap which is to be switched over to, and a load diverter switch with thyristors as switching means for the actual uninterrupted switching over from the previous to the preselected new winding tap under load.

BACKGROUND OF THE INVENTION

Thyristor tap changers of the stated category are usually also termed hybrid tap changers because they have, apart from the thyristors in the load diverter switch as electronic power switching means, also mechanical contacts, particularly mechanical selector contacts. It may be mentioned in passing that there are in addition also so-termed all-thyristor switches, such as, for example, known from WO 95/27931, which entirely dispense with movable mechanical switching elements, but are relatively large and complicated in construction, have not gained acceptance in practice and otherwise are also not the subject of the present invention.

The present invention is concerned with, rather, hybrid thyristor tap changers.

This category of thyristor tap changers can in turn be subdivided into two different apparatus types with different principles of function.

In the first instance there is known from DE 32 23 892 C2 a thyristor tap changer which operates according to the commutation principle. In that case the load switching over is carried out by a controlled commutation of the load current hence the name—from one antiparallel thyristor pair in one branch of the load diverter switch to the respective other thyristor pair in the other branch. Tap changers of this kind have been produced and used sporadically over 80 years as so-called leadthrough tap changers. In that case the active part of the load diverter switch is arranged on a leadthrough insulator post above the transformer tank in an air-filled housing, while the other part of the switch is immersed in the oil-filled transformer tank. The leadthrough insulator post is partly filled with insulating oil and connected with the ambient air by way of a silica gel seal. Disposed within the housing of the active part is a frame which receives the electronic subassemblies of the load diverter switch. The leadthrough support itself is fastened on an attachment flange; a carrier cage with terminal contacts is disposed in the load diverter switch oil chamber upwardly closed off by an attachment flange cover plate. Such a switch, however, has a very large space requirement, particularly due to the large porcelain leadthrough between the electronics housing above the actual transformer and the part, which is lowered into the transformer, of the apparatus with the carrier cage and the mechanical auxiliary switches. In addition, access to the individual components in the oil-filled region is also difficult, so that maintenance operations are complicated and awkward to perform. Overall, this type has not been able to gain acceptance in the past.

Further, as the other of the two types of apparatus a thyristor tap changer with transition resistance is known from WO 98/48432. In that case there is provided a single antiparallel thyristor pair with which a transition resistance lies in parallel. Not only the thyristor pair, but also the transition resistance can be actuated in a specific switching sequence and connected into the current circuit by specific mechanical switching-over contacts. In that case the load current briefly flows across the transition resistance during the load changeover and subsequently a circuit current, which is driven by the tap voltage of the regulating winding. The constructional build-up of a thyristor tap changer of practical execution based on this circuit is known from the company publication 'OLTC Hybrid-Diverter Switch with Thyristors' of the company ELIN OLTC GMBH, Austria, and from the article 'Hybrid-Transformatorstufenschalter TADS-ein zukunftsweisendes Konzept zur Verlangerung der Wartungsintervalle' in the periodical 'e & i', Vol. 11, 1999. The entire switch is in that case conceived as a complete insert able to lowered fully into the oil-filled transformer tank. It is disadvantageous in this construction that the thyristors are exposed to the hot transformer oil. This prejudices the long-term endurance of these electronic components which, as a rule, function reliably only in ambient temperatures up to approximately 100 degrees C. The problem is further aggravated by the fact that in the transition resistance—or, in practice, usually several transition resistances which are present—due to the current loading a quite substantial amount of energy has to be converted into additional heat, which puts at risk the function of the thyristors. In the case of the described known tap changers this has the consequence that only a limited number of load changeovers should be undertaken within a specific time period, so that the heat development caused by the transition resistances does not exceed a limit value. This is undesirable for numerous industrial cases of use. In this connection it has already been proposed to provide an additional temperature switch which blocks the motor drive of the tap changer, and thus temporarily stops the hybrid thyristor switch, when the environment of the thyristors exceeds a specific limit temperature which is not yet harmful. It has proved that this is similarly not practicable in numerous industrial cases of use; apart from that the problem is not solved by such a proposal, but merely a symptom cured.

OBJECT OF THE INVENTION

The object of the invention is to provide a thyristor tap changer of the category stated in the introduction, i.e. a hybrid switch, which avoids the described disadvantages, particularly circumvents complicated leadthroughs and insulator post arrangements, is in that case structured to be compact and maintenance-friendly and, subject to appropriate dimensioning of the thyristors, enables a number of switching actions to be executed in succession.

SUMMARY OF THE INVENTION

This object is fulfilled by a thyristor tap changer for uninterrupted switching over between different winding taps of a tapped transformer under load, consisting of a mechanical tap selector for power-free preselection of the respective winding tap which is to be switched over to, and a load diverter switch with at least one anti-parallel thyristor pair for uninterrupted switching over from the previous to the preselected new winding tap under load. According to the invention, the tap selector is arranged in the transformer tank, which is filled with transformer oil, of the tapped transformer. The load diverter switch is by contrast accommodated in a separate housing in air together with the at least one anti-parallel thyristor pair. The housing is arranged laterally of the transformer tank and separated therefrom by a leadthrough plate. Connecting lines from the tap selector to the load diverter switch are led through the leadthrough plates.

At least one transition resistance of the load diverter switch is accommodated in a further separate housing part in air. The further housing part is in turn separated from the housing by a partition. The housing part is in turn separated from the housing by a partition. The housing part can have at least one opening for air circulation. At least one separate fan can be provided for air circulation.

A particular advantage of the invention consists in that the thyristors can be thermally decoupled in simple manner not only from the hot transformer oil, but also from the transition resistances without requiring for that purpose a complicated construction or particularly large leadthrough arrangements. According to a particularly advantageous development of the invention, through a separate arrangement of the transition resistances the energy converted therein into heat can be dissipated in simple manner by a natural or forced cooling circuit, particularly by air cooling. At the same time it is ensured that this heat is not radiated to other parts of the apparatus and heats these excessively or has a detrimental effect on the thyristors. Overall, the thyristor tap changer according to the invention makes it possible to perform any number of load changeovers in succession without, in the case of the given short-term operation of the thyristors, the thermal load capability limits of the thyristors representing a problem.

BRIEF DESCRIPTION OF THE DRAWING

The invention will be explained in greater detail below on the basis of an embodiment.

The sole FIGURE of the drawing is a diagram which shows a thyristor tap changer according to the invention, here in an embodiment with a transition resistance.

SPECIFIC DESCRIPTION

The region lined in gray at the left in the FIGURE shows the oil-filled transformer tank 1. The windings 2, 3 are schematically indicated in this, of which the righthand one is the tapped regulating winding 3 with individual winding taps 1 . . . n. Each of these winding taps 1 . . . n is electrically connected with a fixed contact K1 . . . Kn of a tap selector 4 of the thyristor tap changer. The fixed contacts K1 . . . Kn are electrically connected in known manner by two movable selector contacts 5, 6. The actual load diverter switch 9, which operates in air, is arranged in a separate housing 8 to be disposed outside the transformer tank 1, laterally attached thereto and disposed in connection therewith by way of a leadthrough plate 7. The electrical connecting lines 10, 11 from the tap selector 4 to the load diverter switch 9 as well as the load shunt 12 are led through separate oil-tight leadthroughs 13, 14, 15 in the leadthrough plate. The load diverter switch 9 can consist of different components independently of the respective circuit on which it is based. In the illustrated embodiment the circuit known from WO 98/48432 is shown. In that case D1 and D2 denote the permanent main contacts which in stationary operation conduct the permanent current, i.e. produce the respective connection of one of the movable selector contacts 5 and 6 to a load shunt L. SR denotes a bridging switch to the load shunt L. The reference numeral 16 indicates a single thyristor pair connected in antiparallel manner and CT and CR denote two diverter switches. In that case the root contact of the diverter switch CT is electrically connected with the thyristor pair 16 and the root contact of the diverter switch CR with a transition resistance 17.

According to a particularly advantageous development of the invention, which is illustrated here, a further separate housing part 19 in which the transition resistance 17, similarly in air, is arranged is provided laterally at the separate housing 8 and separated by a partition 18. Openings 20, 21 are provided at the top and bottom in this housing part 19 so that a separate air flow for cooling the transition resistance 17 can be conducted through the housing part 19.

Overall, there results from the figure the particularly simple construction according to the invention. The complete tap selector 4 of the thyristor tap changer is arranged in the oil-filled transformer tank 1 and is washed around by the transformer oil. There is thereby guaranteed not only a lubrication of the mechanical contacts, but also a sufficient electrical strength of the entire arrangement. The actual load changeover, thereagainst, takes place by means of the thyristor pair 16 in air outside the transformer tank 1. A disturbing influence of the hot transformer oil on the thyristor pair 16 is thereby excluded with certainty. The electrical connection between these two subassemblies is similarly particularly simple, since only three electrical connecting lines 10, 11, 12 have to be led through the leadthrough plate 7. It was already explained that it is particularly advantageous to provide the transition resistance 17 in a further separate housing part 19, similarly in air. Thus, there is not only ensured a simple cooling thereof, but also any thermal influencing of the thyristor pair 16 is similarly excluded.

The invention is not limited to the known circuit, which is explained in the embodiment, with one thyristor pair, only one transition resistance and the specific arrangement of additional mechanical switches. Within the scope of the invention there is equally usable any other load diverter switch with an arrangement, of whatever kind, of one or more thyristor pairs as switching means and independently of the number, switching and actuating sequence of any possibly present further mechanical switches or diverter switches. Similarly, the mode and manner of generation of the ignition voltage for the individual thyristors can be solved in numerous ways within the scope of the invention.

We claim:

1. A thyristor tap changer for uninterrupted switching over between different winding taps of a tapped transformer under load, comprising:

a mechanical tap selector for power-free preselection of the respective winding tap which is to be switched over to;

a load diverter switch with at least one anti-parallel thyristor pair for uninterrupted switching over from the previous to the preselected new winding tap under load;

a receiving the tap selector and not the load diverter switch and transformer tank which is filled with transformer oil of the tapped transformer;

a separate housing accommodating the load diverter switch in air together with the at least one anti-parallel thyristor pair, the housing being arranged laterally of the transformer tank and separated therefrom by a leadthrough plate; and connecting lines running from the tap selector to the load diverter switch led through the leadthrough plates.

2. The thyristor tap changer according to claim 1 wherein at least one transition resistance of the load diverter switch is accommodated in a further separate housing part in air, the further housing part in turn being separated from the housing by a partition.

3. The thyristor tap changer according to claim 2 wherein the housing part has at least one opening for air circulation.

4. The thyristor tap changer according to claim 3 wherein at least one separate fan is provided for air circulation.

* * * * *